US007973256B2

(12) United States Patent
Nishimura et al.

(10) Patent No.: US 7,973,256 B2
(45) Date of Patent: Jul. 5, 2011

(54) SPRING-BIASED SWITCH FOR AN ELECTRONIC DEVICE

(75) Inventors: Kenji Nishimura, Fukui (JP); Kenji Yasufuku, Fukui (JP); Yasuchika Kudo, Fukui (JP)

(73) Assignee: Panasonic Corporation, Osaka (JP)

( * ) Notice: Subject to any disclaimer, the term of this patent is extended or adjusted under 35 U.S.C. 154(b) by 512 days.

(21) Appl. No.: 12/171,730

(22) Filed: Jul. 11, 2008

(65) Prior Publication Data

US 2009/0014307 A1 Jan. 15, 2009

(30) Foreign Application Priority Data

Jul. 11, 2007 (JP) ..... 2007-181929

(51) Int. Cl.
*H01H 21/02* (2006.01)

(52) U.S. Cl. ..... 200/553; 200/559; 200/16 D

(58) Field of Classification Search ..... 200/16 R, 200/16 A–16 D, 517, 520, 531–537, 541–547, 200/551, 561–563
See application file for complete search history.

(56) References Cited

U.S. PATENT DOCUMENTS

| | | | | |
|---|---|---|---|---|
| 4,609,795 | A * | 9/1986 | Lavigne et al. | 200/61.19 |
| 5,660,272 | A * | 8/1997 | Janniere et al. | 200/517 |
| 5,796,058 | A * | 8/1998 | Aimi et al. | 200/16 D |
| 7,202,432 | B2 * | 4/2007 | Nishimura | 200/563 |

FOREIGN PATENT DOCUMENTS

| | | | |
|---|---|---|---|
| CN | 2706853 | Y | 6/2005 |
| CN | 2008101280466 | | 12/2009 |
| JP | 2006-318851 | A | 11/2006 |

* cited by examiner

*Primary Examiner* — Renee Luebke
*Assistant Examiner* — Marina Fishman
(74) *Attorney, Agent, or Firm* — RatnerPrestia

(57) ABSTRACT

A spring member is provided in a switch having a lever to receive a pushing force from outside, by bringing an arch-part formed at the left end of the spring member into resilient contact with the bottom surface of the lever, in addition to the movable contact, the spring member also can return the lever. In the case of developing a compact and low-profile switch, the returning force of the lever can be increased to perform electrical connection or disconnection reliably.

4 Claims, 4 Drawing Sheets

SPRING-BIASED SWITCH FOR AN ELECTRONIC DEVICE

TECHNICAL FIELD

The present invention relates to a switch used mainly to detect presence or absence of storage media, or operating condition of mechanisms in a variety of electronic devices.

BACKGROUND ART

In recent years, along with the progress in downsizing and sophisticating of various kinds of electronic devices such as video recorder or personal computer, a compact and low-profile detection switch capable of operating reliably is required to detect presence or absence of storage media or operating condition of mechanisms such as knobs or inlet doors.

A conventional switch is described with reference to FIGS. 4 and 5. FIG. 4 shows a cross-sectional view of the conventional switch. In FIG. 4, the conventional switch has a substantially box shaped open-topped casing 1 formed from insulating resins and a plurality of fixed contacts formed of a conductive thin metal sheet implanted secured on the internal bottom surface of casing 1 with terminals (not shown) extending outward respectively.

Lever 3 formed from insulating resins is housed in casing 1 pivotally with fulcrum 3A at the left end to act as a supporting point. Lever head 3B projecting upward from the top surface of casing 1 is formed at the right end. Movable contact 4 formed of a resilient thin metal sheet is secured on lever 3 with holder 4B at the right end of arm 4A molded inserted on the internal bottom surface of lever head 3B. A substantially arc-shaped contact-part 4C formed on the left end of arm 4A in a slightly bent condition comes into resilient contact with the internal bottom surface of casing 1. Cover 5 formed of a thin metal sheet covers the opening of the top surface of casing 1 and lever head 3A of lever 3 is projecting upward from through-hole 5A of cover 5.

The switch with the above configuration is disposed on a printed circuit board (not shown) with a plurality of wiring patterns formed on its top and bottom surfaces. The terminals extending from fixed contacts 2 are connected electrically with the given wiring patterns of electronic circuits (not shown) of the device by soldering.

FIG. 5 shows a cross-sectional view of the conventional switch in operation. In this configuration, when lever head 3B projecting upward from casing 1 is pushed downward by inserting or extracting storage media such as tapes or discs, or by moving of mechanisms such as knobs or inlet doors, lever 3 pivots downward with the top surface of fulcrum 3A to act as a supporting point as shown in the cross-sectional view in FIG. 5. Along with the pivoting of lever 3, arm 4A of movable contact 4 bends further and contact-part 4C on the left end of arm 4A slides leftward to the direction of fixed contact 2 coming into resilient contact with the internal bottom surface of casing 1. After lever head 3B moves downward a given amount of distance, contact-part 4C comes into resilient contact with fixed contact 2, connecting a plurality of fixed contacts 2 electrically via movable contact 4.

When lever 3 is released from the pushing force, from the state of lever head 3B having been brought into contact with the internal bottom surface of casing 1 by a pivoting operation to the end, lever 3 is then pushed upward to pivot by a restoring force of movable contact 4. Contact-part 4C also slides rightward from fixed contact 2 coming into resilient contact with the internal bottom surface of casing 1 to return to its original state as shown in FIG. 4. Namely, fixed contacts 2 are electrically disconnected from movable contact 4.

Through the electrical connection or disconnection of the switch, the electronic circuits of a device is to detect the presence or absence of storage media such as tapes or discs, or the operating condition of mechanisms such as knobs or inlet doors.

At this time, the resilient restoring force of movable contact 4 to return lever 3 to its original state becomes larger, as the larger the inclined angle θ of the center of contact-part 4C to the top surface of fulcrum 3A at the left end of lever 3, the larger the force acting rightward on contact-part 4C or component of force to the returning direction, enabling lever 3 to return reliably as shown in FIG. 5.

Namely, when arm 4A of movable contact 4 is shortened and the center of contact-part 4C is moved rightward, the inclined angle θ can be larger, which will increase the restoring force of lever 3. In such a case of shortened dimension of arm 4A of movable contact 4, however, the bending amount of arm 4A would also varies, causing a decrease in the force for contact-part 4C to push fixed contact 2 resiliently or so-called contact-pressure.

Therefore, it has been difficult to develop a compact and low-profile switch entirely keeping a stable electrical connection or disconnection as a switch while both the restoring force of lever 3 and contact-pressure on fixed contact 2 are maintained. Following Patent document 1 is known as an example of the Information Disclosure Statement (IDS) for the present invention:

[Patent document 1] Japanese Patent Unexamined Publication No. 2006-318851

SUMMARY OF THE INVENTION

The switch disclosed includes: a substantially box shaped casing where a fixed contact is implanted on its internal bottom surface; and a lever housed pivotally in the casing with a fulcrum formed on one end to act as a supporting point, and a lever head formed projecting upward on the other end to be pushed down from outside. Additionally, the switch includes a movable contact having an arm which is secured in one end on the bottom surface of casing and a contact-part at the other end of the arm is brought into resilient contact with the internal bottom surface or the fixed contact. According to the presence or absence of pushing force from outside, the movable contact connects or disconnects with aforementioned fixed contacts electrically for switching performance. Moreover, the switch has a spring member that is brought into resilient contact with the bottom surface of the lever. In addition to the resilient restoring force of the movable contact coming into resilient contact, the resilience of the spring member can also work to return the lever. Therefore, in the case of developing a compact and low-profile switch the lever can keep a large restoring force, enabling the switch to perform electrical connection or disconnection reliably.

DETAILED DESCRIPTION OF THE PREFERRED EMBODIMENTS

The preferred embodiment of the present invention is described with reference to the drawings. The similar configurations described in the background art have the same reference marks, and the detailed description thereof is simplified.

Preferred Embodiment

Figure 1:
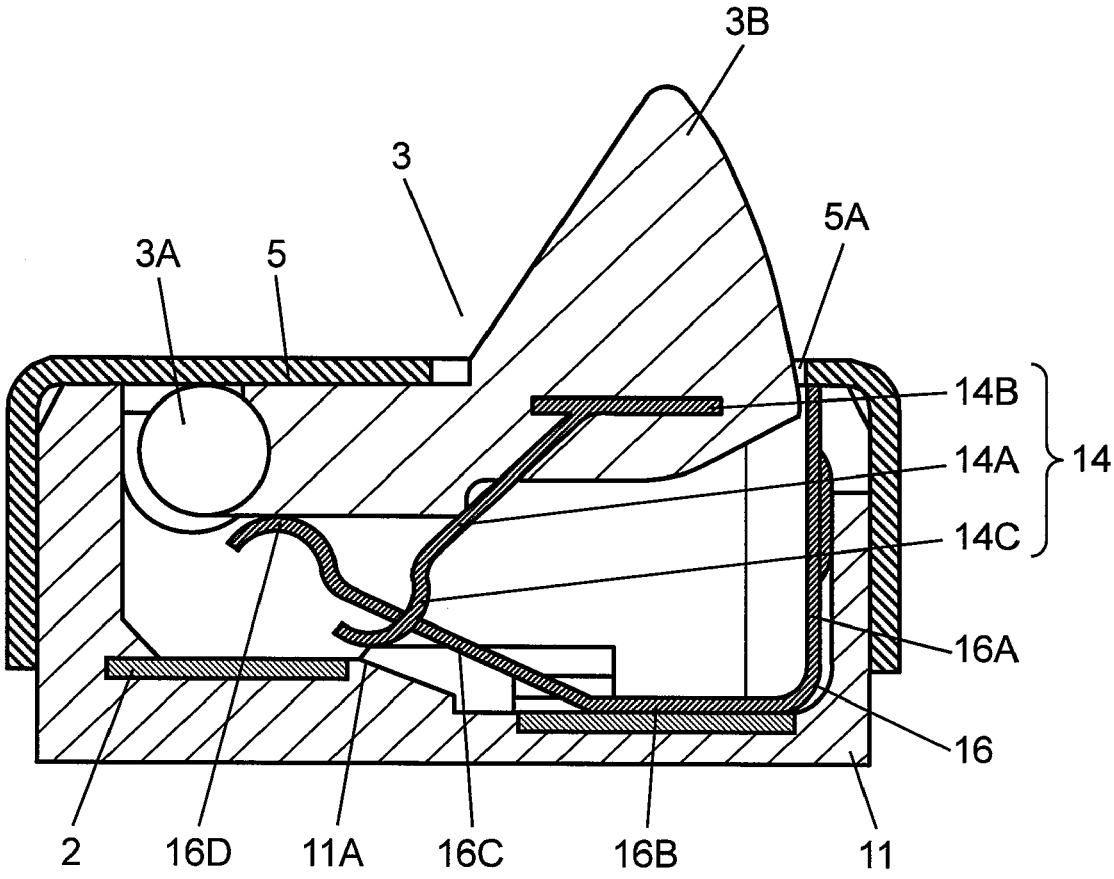
FIG. 1 shows a cross-sectional view of a switch used in the preferred embodiment of the present invention.
Figure 2:
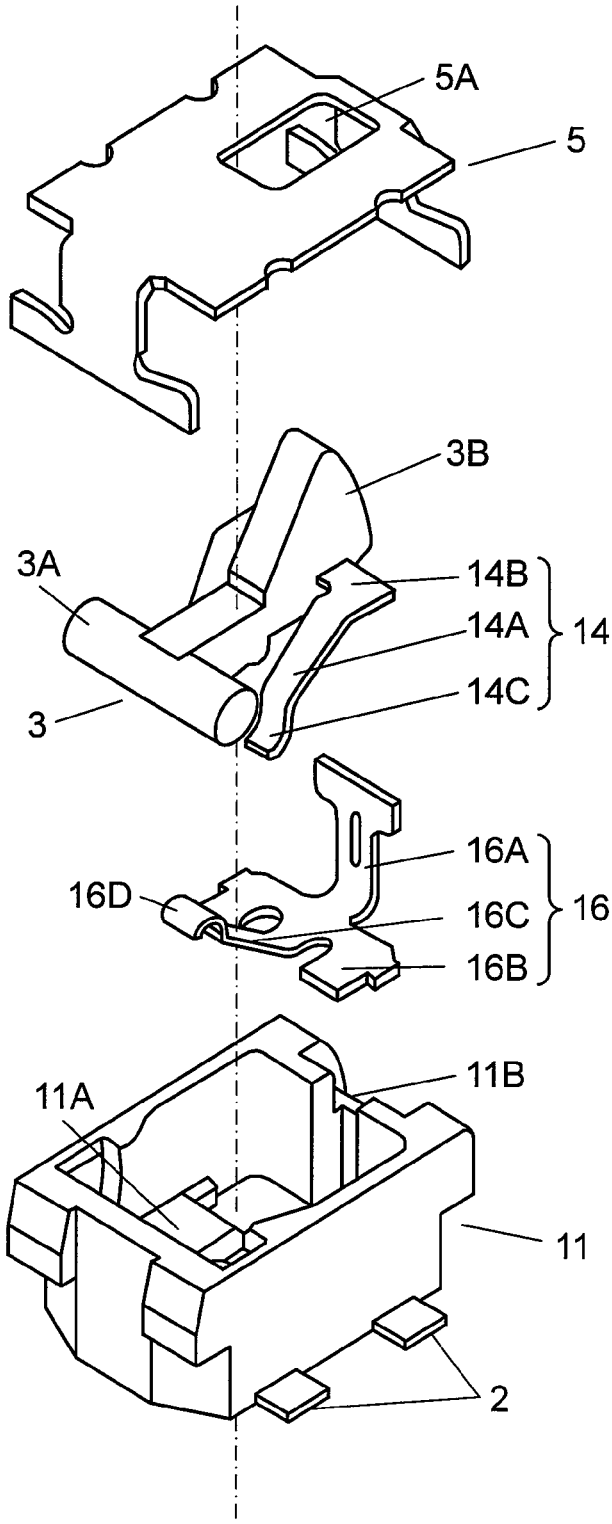
FIG. 2 shows an exploded perspective view of the switch used in the preferred embodiment of the present invention.

FIG. 1 shows a cross-sectional view of the switch used in the preferred embodiment of the present invention, and FIG. 2 shows an exploded perspective view of the same.

In these drawings, open-topped substantially box shaped casing 11 formed from insulating resins such as liquid crystal polymer or polyphenylene sulfide is provided with a step 11A raised upward on the left side of internal bottom surface. A plurality of fixed contacts 2 formed of thin conductive metal sheet such as copper alloy are implanted secured by insert molding. Respective terminals of fixed contacts 2 extend outside as shown in FIG. 2. Lever 3 formed from insulating resins such as liquid crystal polymer or nylon is housed pivotally in casing 11 with substantially cylindrical fulcrum 3A at the left end to act as a supporting point. Lever head 3B projecting upward from the top surface of casing 11 is formed at the right end of lever 3.

Movable contact 14 formed of resilient thin metal sheet is secured on lever 3, with holder 14B at the right end that couples two arms 14A secured on the bottom surface of lever head 3B by insert molding. Substantially arc-shaped contact-part 14C formed at the left end of arm 14A in a slightly bent condition comes into resilient contact with the top surface of step 11A formed on the left side internal bottom surface.

Substantially L-shaped spring member 16 formed of a resilient thin metal sheet such as copper alloy or stainless steel is with the upper end of the right side fold 16A held in slot 11B of casing 11 and with intermediate 16B brought into contact with the right side internal bottom surface. Substantially arc-shaped contact-part 16D formed at the left end of oblique arm 16C in a slightly bent condition comes into resilient contact with the bottom surface of lever 3.

Cover 5 formed of thin metal sheet such as stainless steel covers the opening on the top surface of casing 11 and lever head 3B of lever 3 projects upward from through-hole 5A of cover 5, thereby forming the switch.

A usage of the switch with above configuration is to dispose it on a printed circuit board (not shown) having a plurality of wiring patterns on its top and bottom surfaces, and terminals of fixed contacts 2 extended from casing 11 are soldered on given wiring patterns to connect them electrically with electronic circuits (not shown) of the device.

Figure 3:
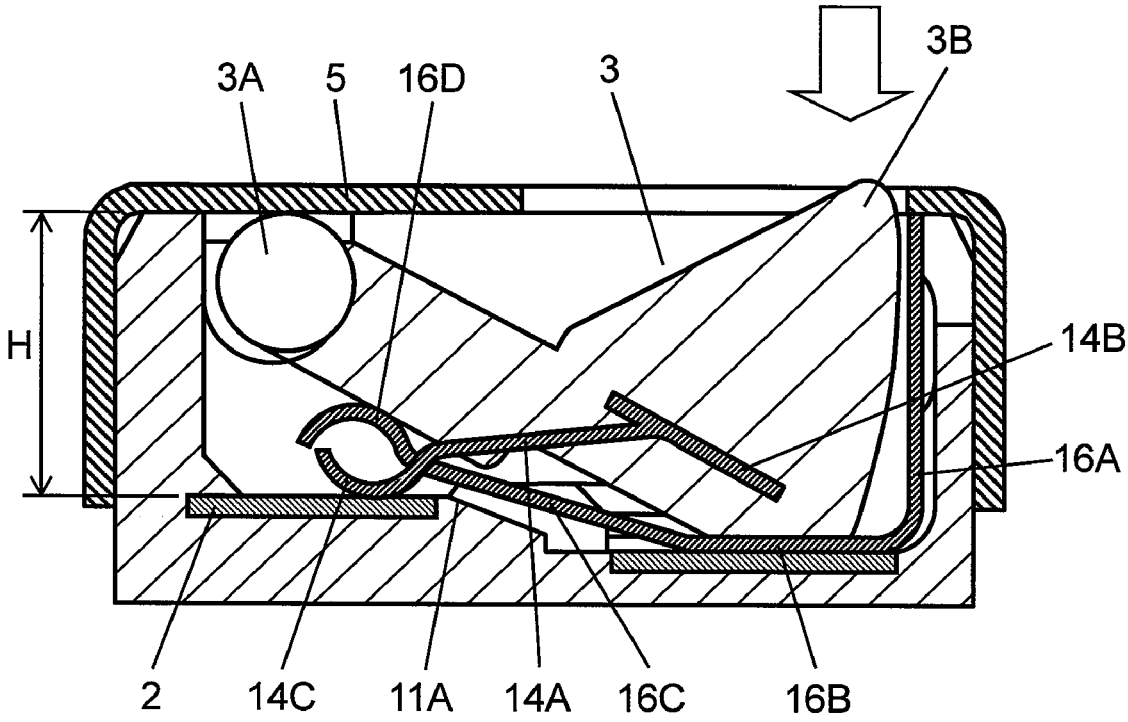
FIG. 3 shows a cross-sectional view of the switch in operation used in the preferred embodiment of the present invention.
Figure 4:
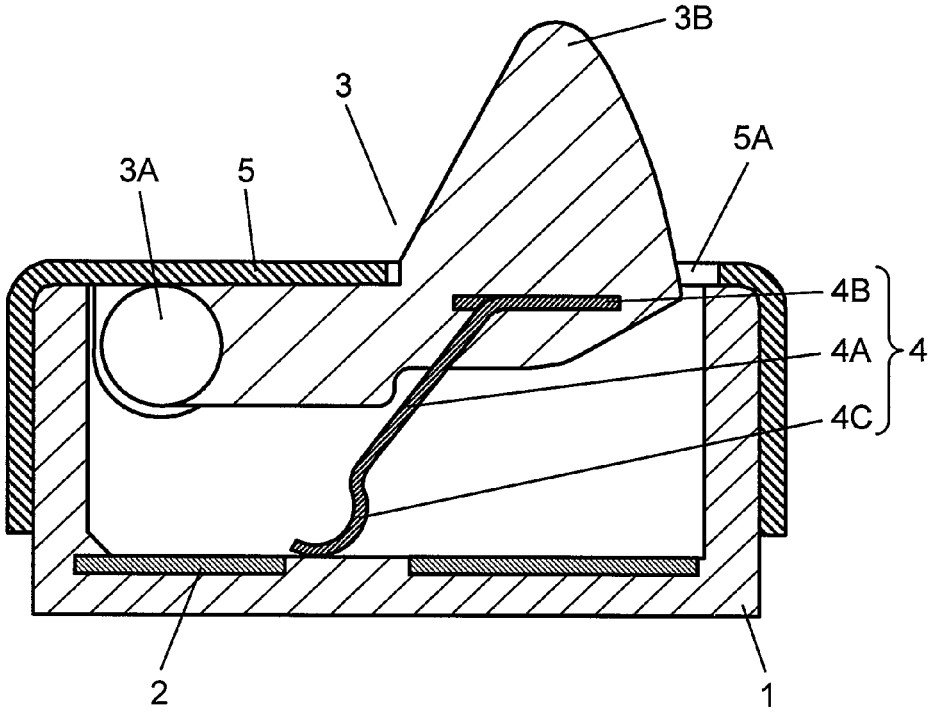
FIG. 4 PRIOR ART
FIG. 4 shows a cross-sectional view of a conventional switch.
Figure 5:
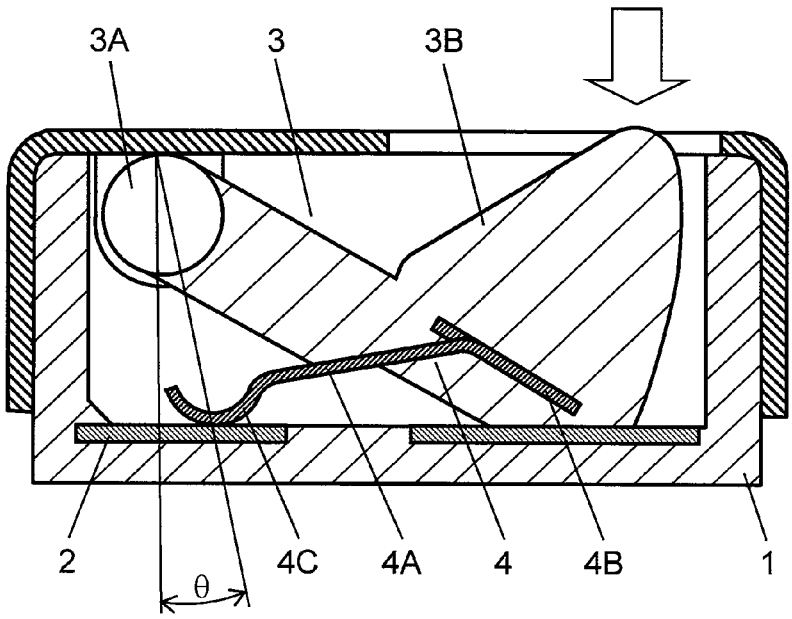
FIG. 5 PRIOR ART
FIG. 5 shows a cross-sectional view of the conventional switch in operation.

FIG. 3 shows a cross-sectional view of the switch in operation used in the preferred embodiment of the present invention. In the configuration described above, lever head 3B projecting upward from casing 1 is pushed downward by inserting or extracting storage media such as tapes or discs, or by moving of mechanisms such as doors or knobs. Lever 3, then, pivots downward, bending oblique arm 16C of spring member 16, with the top surface of fulcrum 3A that comes into contact with the bottom surface of cover 5 to act as a supporting point as shown in the cross-sectional view in FIG. 3. Along with the pivoting of lever 3, arm 14A of movable contact 14 bends further and contact-part 14C at the left end of arm 14A slides leftward to the direction of fixed contact 2, being brought into resilient contact with the top surface of step 11A, thereby allowing lever head 3B to move downward a given amount of distance. Therefore, contact-part 14C comes into resilient contact with fixed contact 2, thus connecting a plurality of fixed contacts 2 electrically via movable contact 14.

In this case, step 11A raised upward is provided on the left side internal bottom surface of casing 11, on which fixed contacts 2 are implanted secured. Therefore, distance H in the vertical direction between the top surface of fulcrum 3A of lever 3 and contact-part 14C of movable contact 14 becomes shorter by the amount of height of step 11A provided in casing 11. That is, as the bending amount of arm 14A becomes larger in proportion to the height amount of step 11A, the force for contact-part 14C to come into resilient contact with fixed contact 2 or so-called contact-pressure becomes larger proportionately, enabling the switch to perform an electrical connection of movable contact 14 with fixed contact 2 reliably.

Additionally, when lever 3 is released from a pushing force in the state of lever head 3B brought into contact on the internal bottom surface of casing 11, lever 3 is pushed upward pivotally by the resilient restoring force generated from movable contact 14 coming into resilient contact with fixed contact 2 and arch-part 16D, that is brought into resilient contact with the bottom surface of lever 3, of spring member 16. At the same time, contact-part 14C also slides rightward from fixed contact 2, being brought into contact on the top surface of step 11A, to return to its original condition shown in FIG. 1. Namely, fixed contact 2 is electrically disconnected from movable contact 2.

In most devices, electronic circuits of the device detect presence or absence of storage media such as tapes or discs, or operating condition of mechanisms of knobs or doors through electrical connection or disconnection in the switch as described above.

As described in the above embodiment, the switch has a large restoring force to return lever 3 back to the original state by substantially L-shaped spring member 16 having arch-part 16D, brought into resiliently contact with the bottom surface of lever 3, at the left end of oblique arm 16C, in addition to movable contact 14 having contact-part 14C, at the left end of arm 14A, brought into resilient contact with fixed contact 2.

Therefore, in the case of downsized movable contact 14 or spring member 16 for developing a compact and low-profile switch, the switch can return lever 3 to its original state reliably, thus enabling the switch to perform electrical connection or disconnection reliably.

Spring member 16 has fold 16A at the right end with upper end held in slot 11B of casing 11, intermediate 16B brought into contact with right side internal bottom surface of casing 11, and substantially circular shaped arch-part 16D brought into resilient contact with the bottom surface of lever 3. Upon pushing operation of lever head 3B, therefore, oblique arm 16C bends with little friction and a resilient restoring force of oblique arm 16C allows lever 3 to return back to its original state reliably.

As described in the embodiment, the switch is provided with substantially L-shaped spring member 16 and arch-part 16D, at the left end of spring member 16, brought into resilient contact with the bottom surface of lever 3, which in addition to movable contact 14 can also work to return lever 3. Even in the case of downsizing, therefore, the switch can perform electrical connection or disconnection reliably with a large returning force of lever 3.

Additionally, the switch is provided with step 11A, raised upward on the left side internal bottom surface of casing 11, on which contact-part 14C of movable contact 14 is brought into resilient contact, causing an increase in the bending amount of arm 14A, enabling the contact-pressure of contact-part 14C on fixed contact 2 to increase. This enables movable contact 14 to connect with fixed contacts 2 electrically reliably.

In the above, it is described that the configuration is to connect a plurality of fixed contacts 2 electrically via movable contact 14 by pivoting operation of lever 3 and to disconnect them electrically by releasing the operation. Contrary to this, however, another configuration may be possible for the embodiment of the present invention: with fixed contacts 2 implanted secured in the center of internal bottom surface of casing 11, contact-part 14C of movable contact 14 is brought into resilient contact with fixed contacts 2 to connect them electrically in idle time, and contact-part 14C is disconnected from fixed contacts 2 electrically in operate time.

Spring member 16 has fold 16A at its right end with upper end held in slot 11B of casing 11 and intermediate 16B brought into contact with the right side internal bottom surface of casing 11. Substantially arc shaped arch-part 16D provided at the left end of oblique arm 16C in a slightly bent condition is brought into resilient contact with the bottom surface of lever 3. As just described, another end (upper end of fold 16A), which is extended opposite to one end brought into contact with the bottom surface of lever 3 (16D) are sandwiched and secured in casing 11 with a high mechanical strength, so that spring member 16 will not drop off due to the pushing force from the resilient contact. Namely, the present invention can provide the switch with a long-life.

INDUSTRIAL APPLICABILITY

The switch of the present invention can be made compact and low-profile and can perform electrical connection or disconnection reliably, which is useful mainly for a detection switch in a variety of electronic devices.

The invention claimed is:

1. A switch comprising:

a substantially box shaped casing where a fixed contact is implanted on an internal bottom surface;

a lever housed pivotally in the casing with a supporting point as a fulcrum at a first end thereof, and having a lever head formed at a second end spaced from the fulcrum and projecting upward from the casing;

a movable contact having an arm, a holder disposed at a first end of the arm and secured at a bottom surface of the lever head, and a contact-part formed at a second end of the arm and brought into resilient contact with the internal bottom surface of the casing or the fixed contact; and a spring member having a first part brought into resilient contact with the internal bottom surface of the casing and an arch-part brought into resilient contact with a bottom surface of the lever, wherein the first part is nearer the lever head than the arch-part and the arch-part is nearer the fulcrum than the first part.

2. The switch of claim 1, wherein a step raised upward is provided at an area in an internal bottom surface of the casing, and the fixed contact is provided on the step to form a structure enable the contact-part of the movable contact to bring into resilient contact with the fixed contact.

3. The switch of claim 1, wherein the spring member is sandwiched and secured in the casing at an end opposite to an end with the arch-part.

4. The switch of claim 1, wherein the spring member is a separated member from the movable contact.

* * * * *